United States Patent [19]

Katsuki et al.

[11] Patent Number: 5,035,086

[45] Date of Patent: Jul. 30, 1991

[54] CYLINDRICAL GRINDING MACHINE SUITABLE FOR USE ON THE ROLLS OF A ROLLING MILL OR THE LIKE

[75] Inventors: Masahide Katsuki, Numazu; Tsuneo Shoji, Susono, both of Japan

[73] Assignee: Toshiba Kikai Kabushiki Kaisha, Tokyo, Japan

[21] Appl. No.: 475,853

[22] Filed: Feb. 6, 1990

[30] Foreign Application Priority Data

Feb. 7, 1989 [JP] Japan ..... 1-27870

[51] Int. Cl.[5] ..... B24B 5/00; B24B 47/02

[52] U.S. Cl. ..... 51/49; 51/95 WH; 51/289 R; 51/215 VE

[58] Field of Search ..... 51/49, 95 WH, 103 R, 51/195 R, 289 R, 215 UE, 215 CP, 145 R, 103 WH

[56] References Cited

U.S. PATENT DOCUMENTS

| | | | |
|---|---|---|---|
| 461,828 | 10/1891 | Fry | 51/49 |
| 2,127,210 | 7/1937 | Dunbar | 51/95 WH |
| 4,033,076 | 7/1977 | Price | 51/215 VE X |
| 4,663,892 | 5/1987 | Smith | 51/289 R |

*Primary Examiner*—Frederick R. Schmidt
*Assistant Examiner*—Bruce P. Watson
*Attorney, Agent, or Firm*—Stevens, Davis, Miller & Mosher

[57] ABSTRACT

A grinder capable of disassembling a pair of rolls of a rolling mill each having a pair of bearing assemblies on its opposite ends, separately grinding and reconditioning the disassembled rolls, and reassembling the reconditioned rolls. Included are a pair of opposed wheel stocks each having an abrasive wheel and both movable linearly along respective wheel guideways extending parallel to each other. Two pairs of opposed pivotal work carriers are disposed intermediate the pair of wheel guideways, with each pair of work carriers spaced from each other in a direction parallel to the wheel guideways. Each pair of work carriers are jointly movable between a common centerline position midway between the pair of wheel guideways, and a grinding position adjacent one of the wheel guideways. A set of fluid actuated work lifters are disposed adjacent the centerline position for loading the disassembled rolls on the respective pairs of work carriers, and for unloading the ground rolls therefrom, as the pairs of work carriers are successively moved to the common centerline position. Loaded on the respective pairs of work carriers, the rolls are ground in the grinding positions by being held against the abrasive rolls as the work carriers are pivoted and held in a slanting attitude. A pair of headstocks are provided for revolving the rolls being held against the abrasive wheels.

4 Claims, 4 Drawing Sheets

CYLINDRICAL GRINDING MACHINE SUITABLE FOR USE ON THE ROLLS OF A ROLLING MILL OR THE LIKE

BACKGROUND OF THE INVENTION

This invention relates to grinders, particularly to external grinders, and more particularly to cylindrical grinders. Still more particularly, the invention pertains to a grinding machine capable of automatically grinding and reconditioning the pair of rolls of a rolling mill, with provisions for accepting the pair of rolls combined in proper positional relationship through their bearing assemblies, separating the rolls from each other and, after grinding, reassembling the rolls into the original positional relationship.

Being subject to uneven wear, the rolls of a rolling mill need reconditioning by grinding at regular intervals of time. The conventional practice, long practiced in the rolling industry, has been to remove the rolls from the machine together with the pair of bearing assemblies at both ends of each roll, then to remove the bearing assemblies from the rolls. Each roll has been ground by having its pair of journals rotatably placed on the rests of the grinder. The bearing assemblies have been reinstalled on the roll journals upon completion of the grinding.

The applicant is aware of some advanced grinders that have been recently developed to preclude the trouble of removing and remounting the bearing assemblies of each roll for each grinding operation. Japanese Patent Publication No. 58-15259 represents an example of such advanced roll grinders. This prior art apparatus includes roll supports capable of holding a pair of rolls, each complete with the pair of bearing assemblies, in either a horizontal or a vertical position. The pair of rolls can be ground simultaneously. However, because of this very capability of simultaneously grinding a pair of rolls, the support means therefore must of necessity be inconveniently bulky in size. An additional drawback is that it demands considerable power for actuating the means for pivoting the rolls on the support means, and the clamps for engaging the bearing assemblies.

Japanese Unexamined Patent Publication No. 63-84856 discloses another apparatus capable of grinding rolls with the bearing assemblies thereon. An objection to this known apparatus is the difficulty of automation because of the fact that the rolls must be craned between the rolling mill and their swivel supports forming parts of the grinder.

SUMMARY OF THE INVENTION

The present invention seeks to provide a compact, efficient and inexpensive grinding machine capable of disassembling a pair of rolls each having a pair of bearing assemblies, separately grinding the disassembled rolls, and reassembling them, all through a streamlined automatic sequence.

Briefly, the invention may be summarized as a cylindrical grinding machine capable of separately grinding two workpieces such as the pair of rolls of a rolling mill. The machine comprises a pair of opposed wheel stocks each having an abrasive wheel and both reciprocably movable respectively along a pair of wheel guideways extending parallel to each other. Disposed intermediate the pair of wheel guideways, a pair of opposed work carrier means are movable in a direction at right angles with the wheel guideways, between a common centerline position midway between the pair of wheel guideways and separate grinding positions adjacent the respective wheel guideways. A work lifter means is disposed adjacent the centerline position for loading the two workpieces on the respective work carrier means, and for unloading them from the work carrier means, as the work carrier means are successively moved to the centerline position. Loaded on the respective work carrier means in the centerline position, the two workpieces are thereby carried to the grinding positions and held against the abrasive wheels as the work carrier means are tilted toward the same in the grinding positions. A pair of headstocks are provided for revolving the workpieces being held against the abrasive wheels.

The pair of rolls of a rolling mill to be reconditioned are supplied with their pairs of bearing assemblies interengaged in a readily separable manner. The two pairs of bearing assemblies are disengaged from each other as the work lifter means successively carry the rolls to the centerline position and load them on the respective work carrier means. The pair of rolls are ground with the bearing assemblies held mounted in place thereon. Then, after grinding, the pair of rolls with the bearing assemblies are reassembled on being unloaded from the work carrier means by the work lifter means and thereby carried back to the initial position. All such operation of the machine can be automated.

The above and other features and advantages of this invention and the manner of realizing them will become more apparent, and the invention itself will best be understood, from a study of the following description and appended claims, with reference had to the attached drawings showing a preferred embodiment of the invention.

DESCRIPTION OF THE PREFERRED EMBODIMENT

Figure 1:
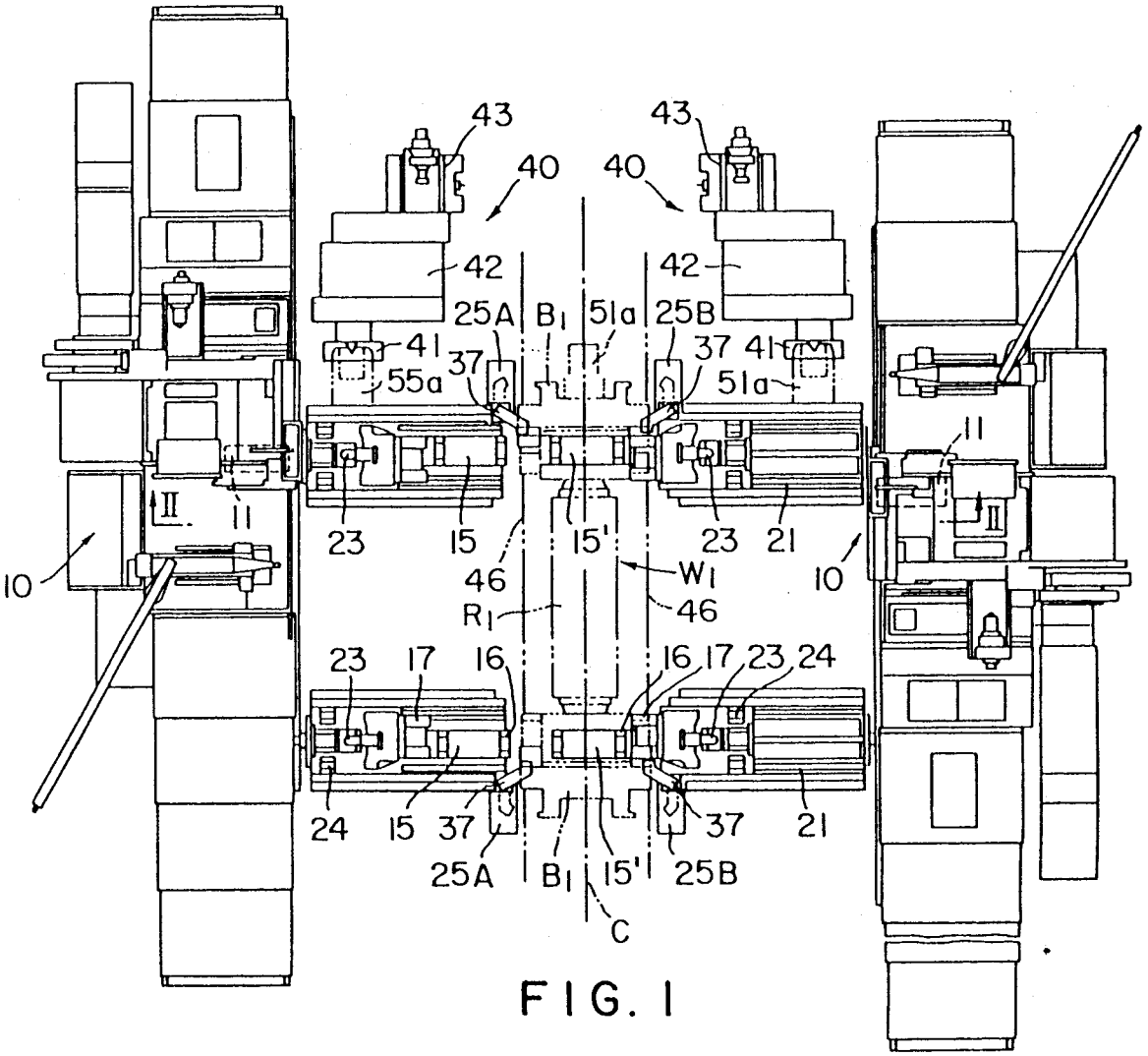
FIG. 1 is a top plan of the for grinding the pair of rolls of a rolling mill in accordance with the novel concepts of the invention.

The cylindrical grinder of this invention will now be described more specifically as adapted for reconditioning the top and bottom rolls of a rolling mill each having a pair of bearing assemblies on its opposite ends. As seen in both FIGS. 1 and 2, the illustrated roll grinding machine has a pair of opposed wheel stocks 10 movable along respective wheel guideways 13 extending horizontally in parallel spaced relation to each other. Each wheel stock 10 includes a wheel head 11 rotatably supporting an abrasive wheel 12. Both wheel stocks 10 are mounted one on each of a pair of wheel carriages 14 which are reciprocably slidable or otherwise movable along the respective wheel guideways 13.

Disposed intermediate the pair of wheel guideways 13 are two pairs of pivotal work carriers 15 and 15', with each pair of work carriers spaced from each other in a direction parallel to the wheel guideways. The work carriers 15 and 15' are pivotally mounted on respective carrier carriages 18 which are movable along respective carrier guideways 21 extending horizontally and at right angles to the wheel guideways 13. Fluid actuated cylinders 22, preferably hydraulic, are coupled one to each carrier carriage 18 for moving the same along the associated carrier guideway 21..

Figure 2:
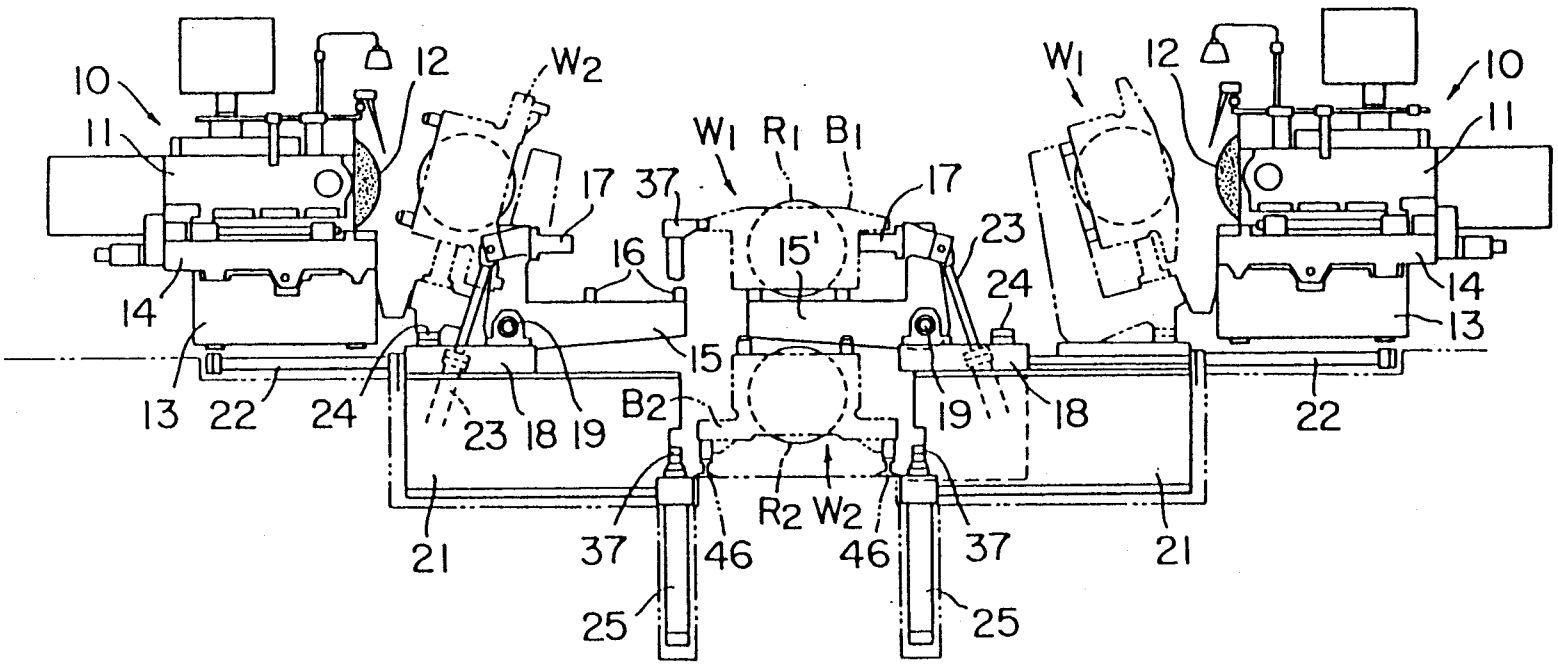
FIG. 2 is horizontal section through the grinding machine of FIG. 1, taken along the line II—II therein.

FIGS. 1 and 2 show the right hand pair, as seen in these figures, of work carriers 15' in a position of register with the centerline C, between the pair of wheel guideways 13. The right hand pair of work carriers 15' are also shown loaded with the top roll $R_1$ of a rolling mill to be ground, the top roll having a pair of bearing assemblies $B_1$ on its opposite ends. The right hand pair of work carriers 15' operate to transport the top roll $R_1$ along the associated pair of carrier guideways 21 between this centerline position and a grinding position adjacent the right hand wheel guideway 13.

FIGS. 1 and 2 also show the left hand pair of work carriers 15 in another grinding position adjacent the left hand wheel guideway 13. The left hand pair of work carriers 15 operate to transport the bottom roll $R_2$ to be ground along the other pair of carrier guideways 21 between this grinding position and the noted centerline position, the latter position being common to both pairs of work carriers 15 and 15'.

The term "workpiece" will be used hereafter to refer to each roll $R_1$ or $R_2$ to be ground, inclusive of the pair of bearing assemblies on its opposite ends, except where the top and bottom rolls and their bearing assemblies must be individually identified as such. Further the top roll $R_1$ together with its pair of bearing assemblies $B_1$ will be collectively designated $W_1$, and the bottom roll $R_2$ together with its pair of bearing assemblies will be collectively designated $W_2$.

Figure 4A:
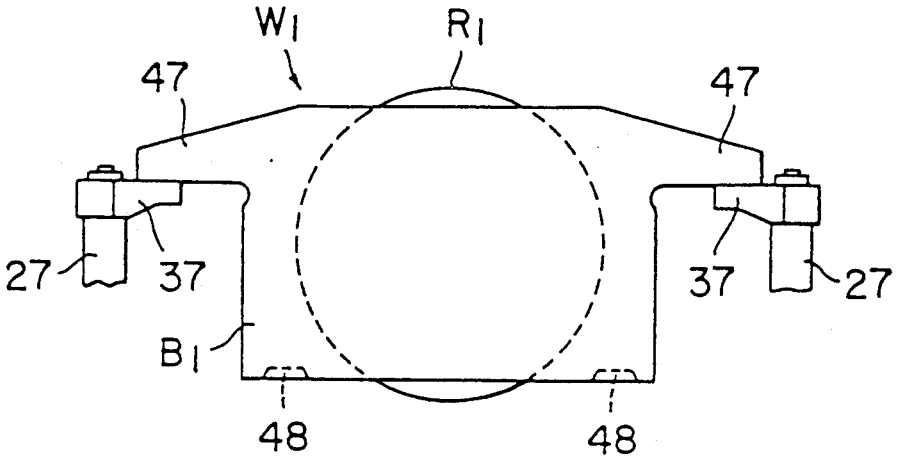
FIG. 4A is an enlarged end elevation of the top roll of a rolling mill, complete with a pair of bearing assemblies on its opposite ends, to be ground by the machine of FIGS. 1 and 2, the top roll being shown raised by the work lifters of FIG. 3.
Figure 4B:
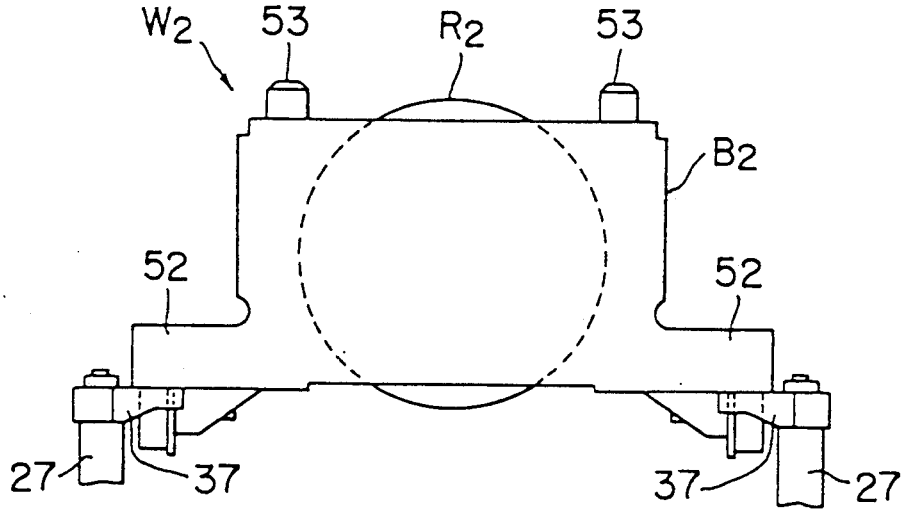
FIG. 4B is an enlarged end elevation of the bottom roll of a rolling mill, complete with a pair of bearing assemblies on its opposite ends, to be ground simultaneously with the top roll of FIG. 4A by the machine of FIGS. 1 and 2, the bottom roll being shown raised by the work lifters of FIG. 3.

FIGS. 4A and 4B are enlarged illustrations of the workpieces $W_1$ and $W_2$ to be ground by the machine of FIGS. 1 and 2. As shown in FIG. 4A, the workpiece $W_1$ is constituted of the top roll $R_1$ and the pair of top bearing assemblies $B_1$, one seen, at the opposite ends of the top roll. Generally rectangular in shape, each top bearing assembly $B_1$ has a pair of flanges 47 extending laterally from its top end, and a pair of holes 48 are formed in its bottom face.

With reference to FIG. 4B the other workpiece $W_2$ comprises the bottom roll $R_2$ and the pair of bottom bearing assemblies $B_2$, one seen, at the opposite ends of the bottom roll. Also generally rectangular in shape, each bottom bearing assembly $B_2$ has a pair of flanges 52 extending laterally from its bottom end. A pair of positioning pins 53 project upwardly from the top end of each bottom bearing assembly $B_2$ for engagement in the holes 48 in the associated top bearing assembly $B_1$. The top and bottom rolls $R_1$ and $R_2$ are held in proper positions relative to each other as the positioning pins 53 on the bottom bearing assemblies $B_2$ are inserted in the holes 48 in the top bearing assemblies $B_1$.

As will be understood by referring back to FIGS. 1 and 2, the spacing between each pair of work carriers 15 or 15' is equal to the spacing between the pair of bearing assemblies $B_1$ on the opposite ends of the top roll $R_1$ and between the pair of bearing assemblies $B_2$ on the opposite ends of the bottom roll $R_2$. Thus each pair of work carriers 15 or 15' conjointly support one of the workpieces $W_1$ and $W_2$ by engaging its pair of bearing assemblies $B_1$ or $B_2$. A set of work rests 16 and 17 are formed on each work carrier 15 or 15' to enable the same to firmly engage the bearing assembly $B_1$ and $B_2$ not only during the transportation of the workpieces $W_1$ and $W_2$ between the centerline and grinding positions but also during the grinding of the workpieces by the abrasive wheels 12.

In the shape of the capital L, each of the work carriers 15 and 15' is pivotally supported at the junction between its two constituent arms by a pivot pin 19 on one of the carrier carriages 18. All the pivot pins 19 extend parallel to the wheel guideways 13, so that the work carriers 15 and 15' are pivotable as shown in FIG. 2 about the axes parallel to the wheel guideways. Pivoted in the grinding positions to the slanting attitudes indicated by the phantom outlines in FIG. 2, the two pairs of work carriers 15 and 15' hold the workpieces $W_1$ and $W_2$ against the abrasive wheels 12 for grinding. A pair of limit stops 24 are formed on each carrier carriage 18 for limiting the pivotal displacement of the work carriers 15 and 15' toward the abrasive wheels 12. The work carriers 15 and 15' may be pivoted 75 degrees or so from their horizontal to slanting attitude in the grinding positions.

At 23 are seen hydraulic cylinders for pivoting the work carriers 15 and 15' in the grinding positions as above. These cylinders 23 will be hereinafter referred to as the carrier cylinders in contradistinction to the first recited cylinders 22, which may then be termed the carrier carriage cylinders. Each carrier cylinder 23 is pivotally coupled at one end to one of the work carriers 15 and 15' and at the other end to one associated carrier carriage 18.

Disposed adjacent to, and on both sides of, the centerline C between the two wheel guideways 13 are two pairs of hydraulic work lifters 25 which are all of identical construction.

Figure 3:
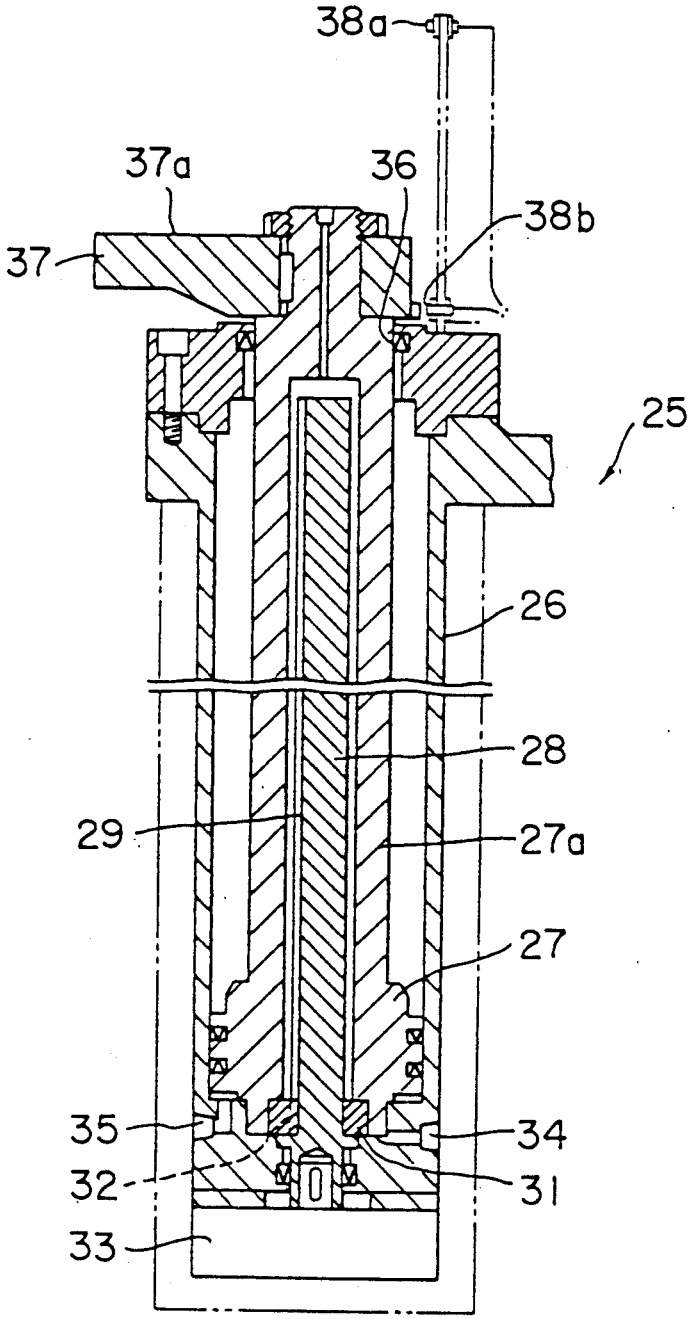
FIG. 3 is an enlarged axial section through each work lifter used in the machine of FIGS. 1 and 2.

FIG. 3 reveals the axial section through each of the hydraulic work lifters 25. It will be seen from this detailed illustration that each work lifter 25 has an upstanding tubular housing 26 within which there is slidably but pressure tightly mounted a piston 27 having a piston rod **27*a* extending upwardly therefrom. Both piston 27 and piston rod 27*a* are hollowed to coaxially receive a rotary spindle 28. The bottom end of this spindle is coupled to a rotary actuator 33 capable of imparting rotation to the spindle 28 through a preassigned angle of, typically, 120 degrees. The spindle 28 has formed therein a keyway 29 extending parallel to its axis. Pressfitted in the bottom end of the piston 27, a collar 31 has formed in its inside surface a key 32 slidably engaged in the keyway 29 in the spindle 28**.

Thus the piston 27 with the piston rod **27*a* of each work lifter 25 is both movable up and down relative to the spindle 28 and rotatable therewith relative to the housing 26. Ports 34 and 35 are formed adjacent the bottom end of the housing 26 for the ingress and egress of a hydraulic fluid under pressure into and out of the bottom chamber defined within the housing by the piston 27. The piston rod 27*a* extends out of the housing 26 through a radial and thrust bearing 36**.

Projecting out of the work lifter housing 26, the top end of the piston rod **27*a* has a lift arm 37 coupled thereto. The lift arm 37 has a flat top surface 37***a* disposed horizontally. Seen at 38*a* and 38*b* are electric switches or sensing devices for detecting the vertical positions of the lift arm 37.

A reference back to FIGS. 1 and 2 will indicate that the two pairs of work lifters 25 function to carry the top and bottom rolls $R_1$ and $R_2$ up and down by engaging their bearing assemblies $B_1$ and $B_2$. As is apparent from the foregoing description of FIG. 3, the lift arms 37 of work lifters 25 are angularly displaceable between the working positions indicated by the solid lines in FIG. 1 and the retracted positions indicated by the broken lines. When in the solid line working positions, the lift arms 37 of each pair of work lifters 25 generally extend toward each other for engaging one of the bearing assemblies $B_1$ or $B_2$ of the roll $R_1$ or $R_2$. When in the phantom retracted positions, on the other hand, the lift arms 37 of each pair of work lifters provide a spacing therebetween that is greater than the maximum transverse dimension of the bearing assembly $B_1$ or $B_2$.

The roll grinding machine further comprises two headstocks 40 disposed side by side between the pair of grinder guideways 13 for imparting rotation to the respective workpieces $W_1$ and $W_2$ in predetermined grinding positions opposite the wheel stocks 10. Each headstock 40 includes a work head 42 with a work spindle 40*a* extending therefrom and terminating in an autocoupling 41, which is movable axially into and out of engagement with either of the workpieces $W_1$ and $W_2$ in the grinding positions. A drive mechanism 43 revolves the work spindle 40*a*. The headstocks 40 with the retractable autocouplings 41 are per se conventional in the art.

OPERATION

Normally, that is, when no work is loaded in the roll grinding machine, the two pairs of work carriers 15 and 15' on the carrier carriages 18 are all retracted away from each other and held in the horizontal attitude in the grinding positions. The lift arms 37 of the two pairs of work lifters 25 are held in their lowermost positions and also turned approximately parallel to each other as depicted by the broken lines in FIG. 1. The autocouplings 41 of the two headstocks 40 are also held retracted.

Removed from the rolling mill, the pair of rolls $R_1$ and $R_2$ together with the bearing assemblies $B_1$ and $B_2$ are to be transported in combined form (i.e. with the positioning pins 53 on the bottom bearing assemblies engaged in the holes 48 in the top bearing assemblies) to a position of register with the centerline C, FIG. 1, between the two pairs of work lifters 25. The stack of workpieces $W_1$ and $W_2$ may be stopped when their bearing assemblies $B_1$ and $B_2$ come to positions of vertical alignment with the work lifters 25.

Broadly, the invention permits use of any convenient means for transporting the stack of workpieces $W_1$ and $W_2$ to the required position on the grinding machine. A preferred example of such means is a pair of guide rails, shown at 46 in FIGS. 1 and 2, laid parallel to the centerline C and on a horizontal plane below that of the carrier guideways 21.

Then a hydraulic fluid under pressure may be introduced into the two pairs of work lifters 25 thereby causing the ascent of the pistons 27 along the spindles 29. The ascent of the pistons 27 may be discontinued when the lift arms 37 on the piston rods 27*a* come to a horizontal plane just under the flanges 47 of the bearing assemblies $B_1$ of the top roll $R_1$.

Then the rotary actuators 33 of the work lifters 25 may be energized to swivel the lift arms 37 through the required angle of 120 degrees or so. The revolution of each rotary actuator 33 is transmitted to the associated lift arms 37 through the rotary spindle 28, the collar 32 keyed to the spindle, and the piston 27 having the collar rigidly attached thereto. So swiveled, the lift arms 37 will come to the solid line positions of FIG. 1, in which they underlie the flanges 47 of the pair of top bearing assemblies $B_1$.

Then the pressurized fluid may again be introduced into the work lifters 25 thereby causing the lift arms 37 to engage the flanges 47 of the pair of top bearing assemblies $B_1$ as shown in FIG. 4A. The lift arms 37 will lift the upper workpieces $W_1$ away from the lower workpiece $W_2$ with the continued introduction of the pressurized fluid into the work lifters 25. The ascent of the lift arms 37 may be discontinued when the upper workpieces $W_1$ comes to a position slightly above the plane of the work rests 16 of the work carriers 15 and 15' which are now assumed to be held in the horizontal attitude in the grinding positions.

Then either of the two pairs of work carriers 15 and 15' may be driven to the centerline position under the upper workpiece $W_1$ being held in the highest position by the work lifters 25. Let us assume that the right hand pair, as seen in FIGS. 1 and 2, of work carriers 15' are first moved to the centerline position. To this end the associated right hand pair of carrier carriage cylinders 22 may be extended for driving the associated pair of carrier carriages 18 along the carrier guideways 21 toward the centerline C.

Then the pressurized fluid may be withdrawn from within the housings 26 of the work lifters 25 thereby lowering and depositing the upper workpiece $W_1$ on the work rests 16 of the right hand pair of work carriers 15'.

Then the lift arms 37 may be swiveled back to the phantom positions of FIG. 1 by the rotary actuators 33 of the work lifters 25. Then the lift arms 37 may be lowered to the lowermost position past the flanges 52, FIG. 4B, of the bottom bearing assemblies $B_2$. Such up and down movement of the lift arms 37 is automatically controllable as their vertical positions are detected by the switches or sensing devices shown at 38*a* and 38*b* in FIG. 3.

Following the deposition of the upper or first workpiece $W_1$ on the right hand pair of work carriers 15' as above stated, the associated pair of carrier carriage cylinders 22 may be contracted for moving the associated pair of carrier carriages 18, together with the first workpiece $W_1$ thereon, along the carrier guideways 21 to the grinding position adjacent the right hand wheel stock 10. The first workpiece $W_1$ will thus be carried close to the right hand wheel stock 10 together with the work carriers 15' on the right hand pair of carrier carriages 18.

Then the right hand pair of carrier cylinders 23 may be contracted for pivoting the pair of work carriers 15' through the angle of 75 degrees or so in a clockwise direction, as viewed in FIG. 2, about the pivot pins 19. The pair of work carriers 15' with the first workpiece $W_1$ thereon will come to rest upon abutment against the limit stops 24, in the position indicated by the broken lines in FIG. 2. The first workpiece $W_1$ will remain in place on the pair of work carriers 15' by butting on the work rests 17 thereon, in addition to on the work rests 16 on which the workpiece has been supported when the work carriers are laid horizontally. The first workpiece $W_1$ has now been brought to the preassigned grinding position opposite the right hand abrasive wheel 12.

Then the autocoupling 41 of the right hand headstock 40 may be extended into coaxial engagement with one of the end journals 51*a*, FIG. 1, of the top roll $R_1$. The top roll $R_1$ will start rotation as the drive mechanism 43 of the right hand headstock 40 is set into operation. Also set into rotation, the abrasive wheel 12 of the right hand wheel stock 10 will grind and recondition the top roll $R_1$ with the concurrent travel of the right hand wheel carriage 14 along the wheel guideway 13.

The reader's attention is invited to the fact that the first workpiece $W_1$ being ground is supported by the pair of work carriers 15' which are angled 75 to the horizontal plane. This slanting attitude of the work carriers 15' makes it unnecessary to provide any devoted means for clamping the work during machining as it weighs itself down on the work rests 16 and 17 on the work carriers.

After having been moved back to the lowermost position as aforesaid, the lift arms 37 may be swung back to the positions just under the pairs of flanges 52 of the bearing assemblies $B_2$ of the bottom roll $R_2$. Then this second workpiece $W_2$ may be raised by the work lifters 25 to a position slightly above the plane of the work rests 16 of the left hand pair of work carriers 15.

Then the left hand pair of carrier carriage cylinders 22 may be extended for moving the left hand pair of work carriers 15, together with the associated pair of carrier carriages 18 on which they are mounted, to the position under the second workpiece $W_2$ being held raised in the centerline position.

Then the lift arms 37 may be lowered again, thus depositing the second workpiece $W_2$ on the work rests 16 of the left hand pair of work carriers 15. Then the lift arms 37 may be swiveled back to the phantom retracted positions of FIG. 1 and further lowered to the initial lowermost position by the work lifters 25.

Resting on the left hand pair of work carriers 15, the second workpiece $W_2$ may then be carried to the grinding position opposite the left hand wheel stock 10 and then turned to the angular position of 75 degrees with respect to the plane of the horizon, through the procedure previously set forth in connection with the first workpiece $W_1$.

Then, with the second workpiece $W_2$ held angled in the grinding position opposite the left hand abrasive wheel 12, the autocoupling 41 of the left hand headstock 40 may be extended into coaxial engagement with the end journal 55*a*, FIG. 1, of the bottom roll $R_2$. Then the drive mechanism 43 of the left hand headstock 40 may be set into motion to impart rotation to the bottom roll $R_2$. The abrasive wheel 12 of the left hand wheel stock 10 will grind and recondition the bottom roll $R_2$ by being both revolved about its own axis and fed transversely along the wheel guideway 13 with the wheel carriage 14.

Upon completion of roll reconditioning, the two workpieces $W_1$ and $W_2$ can be recombined and withdrawn from the machine through the reversal of the foregoing procedure, as briefly outlined below.

First, with the autocoupling 41 of the left hand headstock 40 retracted out of engagement with the second workpiece $W_2$, the left hand pair of work carriers 15 may be pivoted back to the horizontal position, as pictured by the solid lines in FIG. 2. Then the left hand pair of carrier carriages 18 may be moved to the centerline position together with the work carriers 15 and second workpiece $W_2$ thereon. Then the second workpiece $W_2$ may be slightly raised off the left hand pair of work carriers 15 by the two pairs of lift arms 37 in engagement with the bearing flanges 52 and, after the retraction of the left hand pair of work carriers 15 away from the centerline position, lowered onto the pair of guide rails 46.

Then the first workpiece $W_1$ may be likewise lowered onto the second workpiece $W_2$ already resting on the pair of guide rails 46. The two workpieces $W_1$ and $W_2$ can be reassembled simply as the positioning pins 53 on the bottom bearing assemblies $B_2$ are engaged in the holes 48 in the top bearing assemblies $B_1$. The reassembled workpieces may then be withdrawn from the machine along the guide rails 46.

Having thus described the construction and operation of the exemplary roll grinding machine, it is believed easy for the specialists to fully automate the complete sequence of loading the pair of rolls, complete with the pair of bearing assemblies on each roll, into the machine, disassembling the rolls, separately grinding them, reassembling them, and withdrawing them from the machine. The invention will contribute materially to the automation and higher production of the rolling mill.

Despite the foregoing detailed disclosure, however, it is not desired that the grinding machine of this invention be limited to the exemplified application of reconditioning mill rolls, or to the exact details of the illustrated construction. A variety of other applications, and modifications and alterations in construction, will suggest themselves to those skilled in the art within the scope of the invention.

What is claimed is:

1. A loading apparatus for loading two rolls each having a pair of chocks on the end opposite respective grinding positions of a pair of roll grinding machines disposed oppositely on a floor, each roll grinding machine having an abrasive wheel which is reciprocably movable respectively along a pair of wheel guideways extending parallel to each other, comprising:

(a) a pair of opposed roll carrier means having a supporting means of the chock, disposed intermediate to the pair of wheel guideways and reciprocably movable in a direction at right angles to the wheel guideways;

(b) roll lifter means disposed adjacent to a common centerline position located midway between the wheel guideways for loading the two rolls by supporting the chocks on the respective roll carrier means, and for unloading the rolls from the roll carrier means when the roll carrier means are successively moved to the centerline position;

(c) first actuator means for reciprocably moving the pair of roll carrier means between said common centerline position, and respective grinding positions adjacent to the respective wheel guideways; and (d) second actuator means for pivoting the pair of roll carrier means in the grinding positions and hence for holding the rolls loaded thereon against the abrasive wheels of the roll grinding machines.

2. The loading apparatus of claim 1 wherein each roll carrier means comprises:

(a) a pair of carrier carriages spaced from each other in a direction parallel to the wheel guideways and reciprocably movable along respective carrier guideways located on the floor and extending at right angles to the wheel guideways; and (b) a pair of roll carriers pivotally mounted one on each carrier carriage for conjointly supporting one of the rolls.

3. The loading apparatus of claim 2 wherein each roll carrier is substantially L shaped.

4. The loading apparatus of claim 1 wherein the roll lifter means comprises:

(a) a plurality of fluid actuated cylinders each having a piston rod movable in a direction normal to the plane of the wheel guideways;

(b) a lift arm formed on the piston rod of each fluid actuated cylinder and extending right angularly therefrom; and (c) means for swiveling the lift arm through a preassigned angle about the piston rod.

* * * * *